United States Patent [19]

Morello

[11] Patent Number: 4,552,392

[45] Date of Patent: Nov. 12, 1985

[54] HOLD OPEN DEVICE

[75] Inventor: Michael E. Morello, Sandwich, Ill.

[73] Assignee: Caterpillar Tractor Co., Peoria, Ill.

[21] Appl. No.: 574,321

[22] Filed: Jan. 27, 1984

[51] Int. Cl.[4] ..... E05C 1/04

[52] U.S. Cl. ..... 292/181; 292/341.12; 292/340

[58] Field of Search ..... 292/341.12, 340, 277, 292/70, 153, DIG. 73, 177–182

[56] References Cited

U.S. PATENT DOCUMENTS

| | | | |
|---|---|---|---|
| 847,127 | 3/1907 | Stewart | 292/277 X |
| 1,010,482 | 12/1911 | Crowe | 292/277 |
| 1,768,326 | 6/1930 | Miller | 292/175 X |
| 1,886,494 | 11/1932 | Mitchell | 292/341.12 |
| 2,273,149 | 2/1942 | Shannon et al. | 292/182 |
| 2,475,478 | 7/1949 | Clair | 292/181 |
| 2,663,608 | 12/1953 | Schauer | 292/175 X |
| 2,873,989 | 2/1959 | Stone et al. | 292/70 |
| 3,233,932 | 2/1966 | Utterback | 292/175 |
| 4,181,337 | 1/1980 | Muller | 292/271 |
| 4,315,646 | 2/1982 | McReynolds | 292/68 |
| 4,335,911 | 6/1982 | Taylor | 292/262 |
| 4,339,844 | 7/1982 | Shatters | 16/82 |

*Primary Examiner*—Richard E. Moore

*Attorney, Agent, or Firm*—Terry D. Morgan

[57] ABSTRACT

An apparatus for selectively holding a door of a vehicle in a plurality of discrete positions. The apparatus includes a rod reciprocatably disposed within a body fixedly attached to the door. The rod is insertable into a plurality of openings within a bracket fixedly attached to the cab of the vehicle.

6 Claims, 5 Drawing Figures

HOLD OPEN DEVICE

TECHNICAL FIELD

This invention relates generally to an apparatus for holding open a pivotal partition and, more particularly, to a device for maintaining a door or window at one of a plurality of positions while reducing vibrations of the device.

BACKGROUND ART

Previous hold open devices have been directed towards holding a partition i.e., door, window, etc. at either a fully opened position or a partially opened position. In the case of construction equipment where operation of the vehicle commonly occurs in less than ideal conditions, such as dust or rain, it is highly advantageous to be capable of securing the partition at a partially opened position, thereby allowing ventilation to occur while minimizing the intrusion of dust and rain. Conversely, in the presence of somewhat more ideal atmospheric conditions, it is desirable to secure the partition at a fully open position, providing maximum ventilation to the operator.

Additionally, hold open devices have been known to be a source of vibrational noise in both the open and closed positions. This is especially true in the case of heavy equipment where severe impact forces can occur during normal operation. While the noise issuing from the hold open device can be an irritation and a distraction to the operator of the vehicle, the vibration can also lead to fatigue and eventual failure of the hold open device or associated structure.

The present invention is directed to overcoming one or more of the problems as set forth above.

DISCLOSURE OF THE INVENTION

In one aspect of the present invention, an apparatus is provided for selectively locking a partition, which is pivotally connected to a foundation member, in an open position. The apparatus includes a body which has first and second intersecting passages and is connectable to the partition. A rod is reciprocatably disposed in the first passage and can be moved between a first, unlocked position and a second, locked position. The rod has a diameter and a recess alignable with the second passage when the rod is at the second position. A bracket is included and has a mounting element joinable to the foundation member, an engagement plate, and a resilient member fixedly mounted between the mounting element and the engagement plate. The engagement plate and the resilient member each have an opening, respectively, at least as large as and smaller than the rod's diameter and the openings are generally coaxially arranged for reception of one end of the rod in its second position. A lever is pivotably connected to the body and has an engagement portion which is insertable into the recess through the second passage. A first biasing means urges the rod towards the first position and a second biasing means urges the lever's engagement portion into the recess.

BEST MODE FOR CARRYING OUT THE INVENTION

Figure 1:
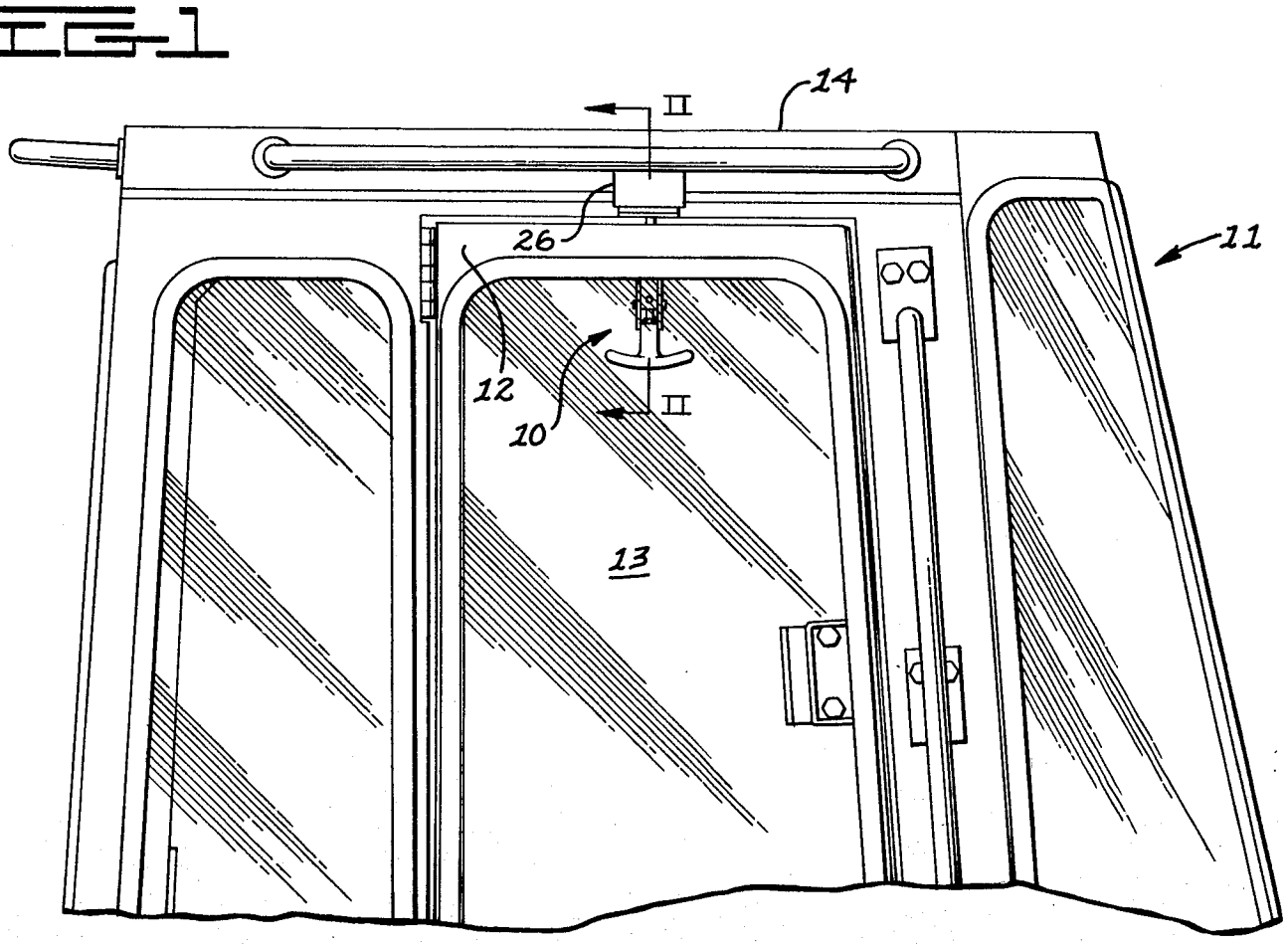
FIG. 1 is a schematic drawing of the present invention shown mounted on an earthmoving vehicle.

Referring to FIG. 1, an apparatus 10 for selectively locks a partition 12 pivotally connected to a foundation member 14, in a partially open configuration. In this embodiment, a cab 11 of a piece of heavy equipment machinery is shown as the foundation member 14 and a door 13 as the partition 12.

Figure 2:
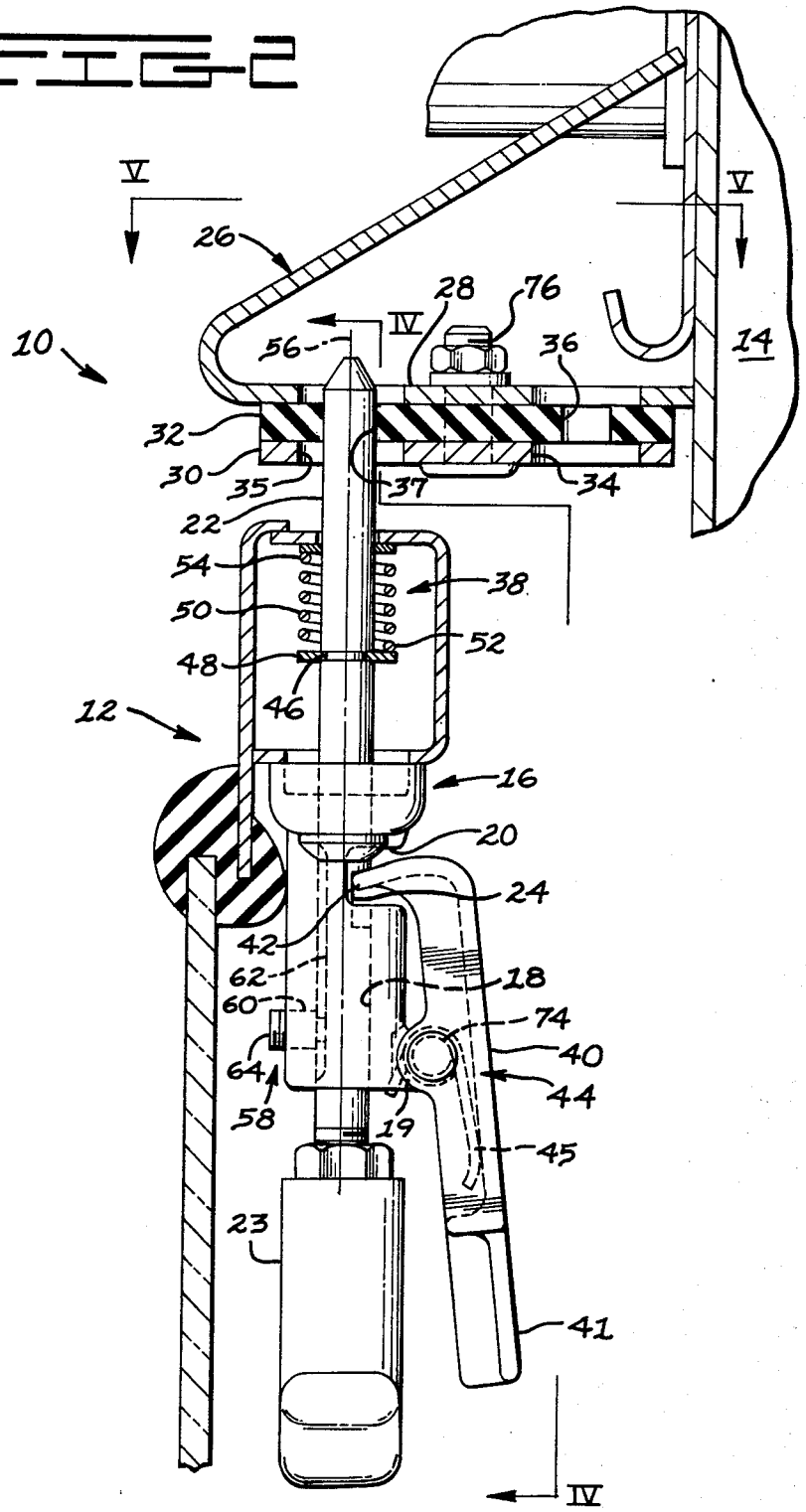
FIG. 2 is a schematic of the present invention shown in the second position from a side elevational view.
Figure 3:
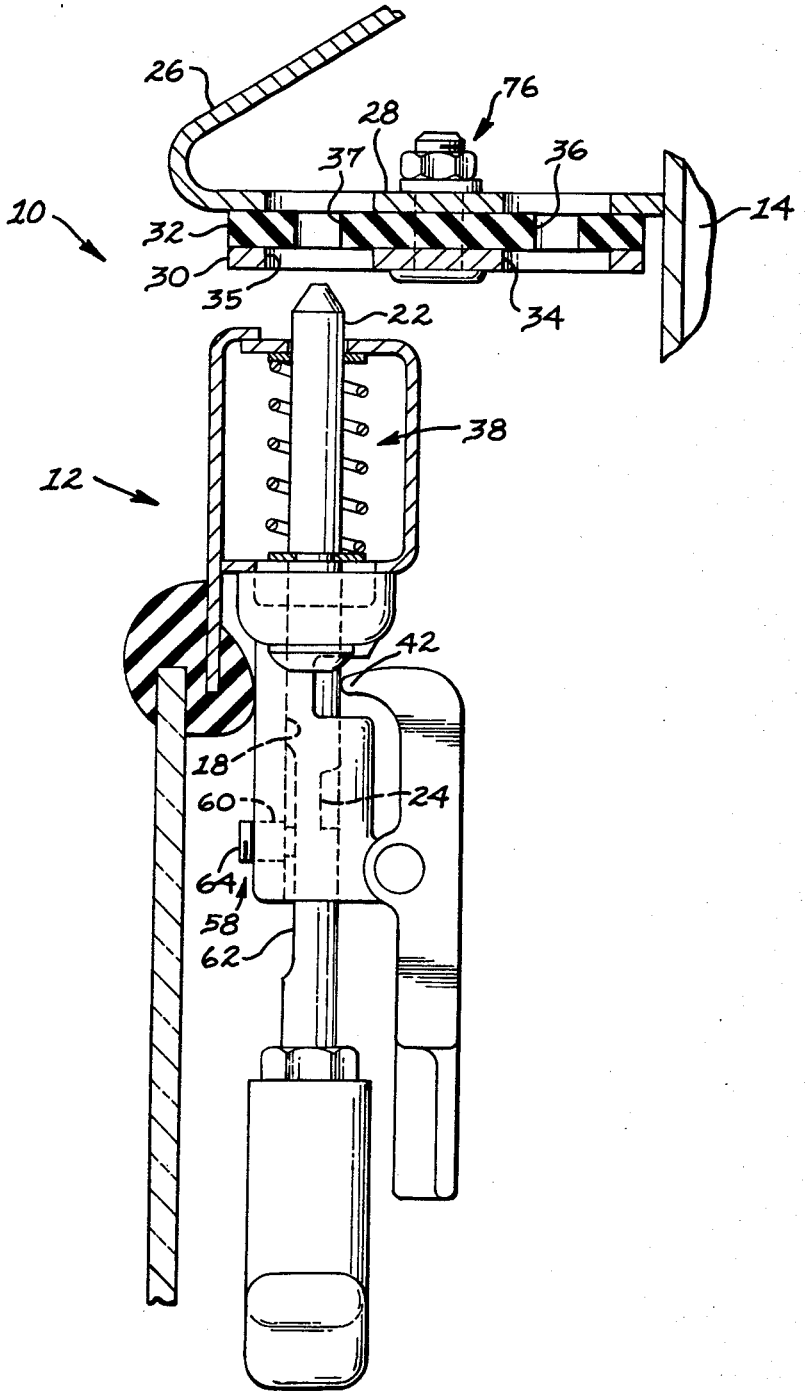
FIG. 3 is a schematic of the present invention shown in the first position from a side elevational view.
Figure 4:
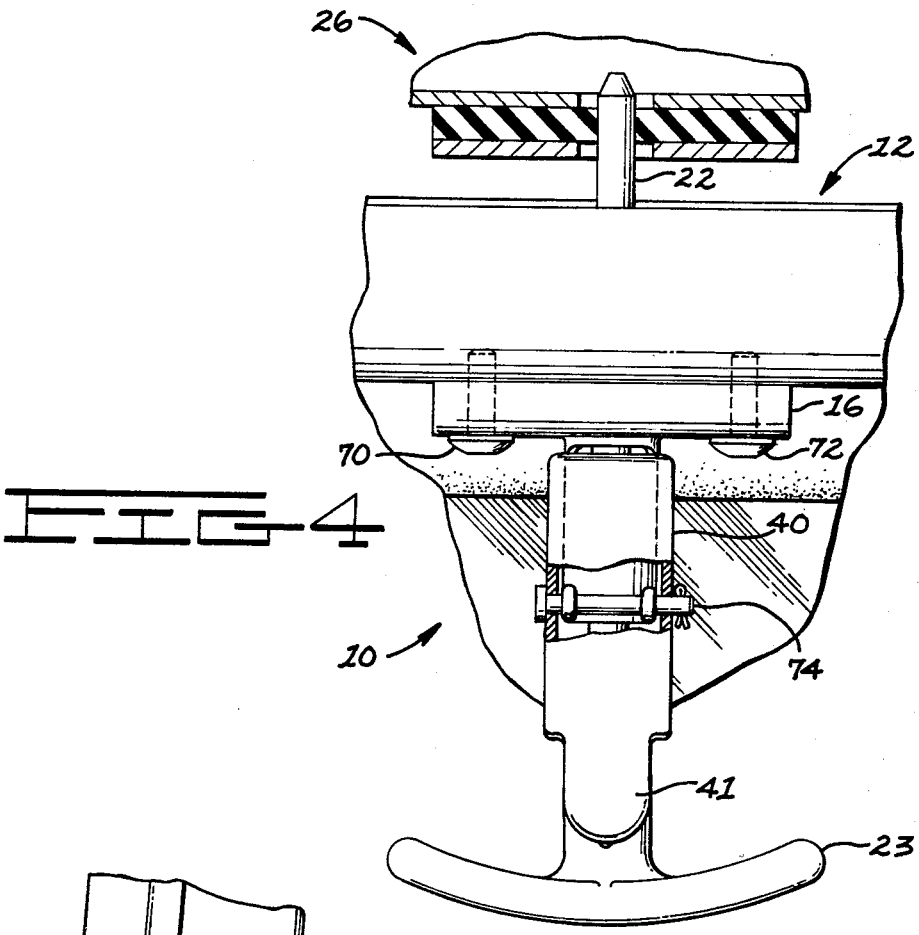
FIG. 4 is a schematic of the present invention shown from a front elevational view.

FIG. 2 shows a detailed diagram of the apparatus 10 wherein a body 16 has first and second intersecting passages 18,20 and is connected to the partition 12 by first and second bolts 70,72 (shown in FIG. 4). A rod 22 is reciprocatably disposed in the first passage 18 and can be moved between a first, unlocked position (shown in FIG. 3) and a second, locked position (shown in FIG. 2). The rod 22 has a diameter with a recess 24. The recess 24 is alignable with the second passage when the rod (22) is at the second position.

The apparatus 10 includes a means 58 for preventing rotation of the rod 22 about its central axis 56. The means 58 includes a third body passage 60 intersecting the first passage 18. The rod 22 has a keyway 62 extending radially along the rod 22 and in general alignment with the third passage 60. Rotation of the rod 22 is successfully prevented by the structure of means 58 and is important to the operation of the apparatus 10 in that rotation of the rod 22 would cause undesirable misalignment of the recess 24 and the second passage 20. Those skilled in the art of mechanical design will recognize that there are a number of similar devices for preventing rotation of the rod 22 which could be employed without departing from the spirit of the instant invention. Additionally, the recess 24 could be extended about the entire periphery of the rod 22 and in this manner the recess 24 could be aligned with the second passage 20 irrespective of the rotational position of the rod 22.

Referring to FIG. 3, a first biasing means 38 urges the rod 22 toward the first position with a force sufficient to prevent vibrational noise or "rattle" from occurring when the rod 22 is in the first position. The first biasing means 38 includes a coil spring 50 which has first and second end portions 52,54 and is disposed about the rod 22. The rod 22 has a groove 46 extending about its periphery and a ring 48 is disposed within the annular groove 46 and extends beyond the diameter of the rod 22. The first and second end portions 52,54 of the spring 50 are in contact with the ring 48 and the partition 12, respectively. The spring 50 functions to force the rod 22 toward the first position at which the ring 48 is in contact with the body 16. Conversely, the spring 50 is axially compressed in response to movement of the rod 22 from the first position toward the second position.

A lever 40 is pivotally connected to the body 16 by a pin 74 and has an engagement portion 42 which is insertable into the recess 24. The pin 74 extends through the lever 40 and a flange 19 which extends from the body 16, and secures the lever 40 to the body 16 and pivotally mounts the lever 40 for movement about the pin 74. A second biasing means 44 urges the lever's engagement portion 42 into the recess 24. The means 44 includes a torsion spring 45 radially disposed about the pin 74, and extending in a direction opposite the engagement portion 42 into forcible contact with said lever 40. When the rod 22 is in the second, locked position of FIG. 2, the engagement portion 42 of the lever 40 pivots into the recess 24 and prevents the rod 22 from being forced to the first position.

Figure 5:
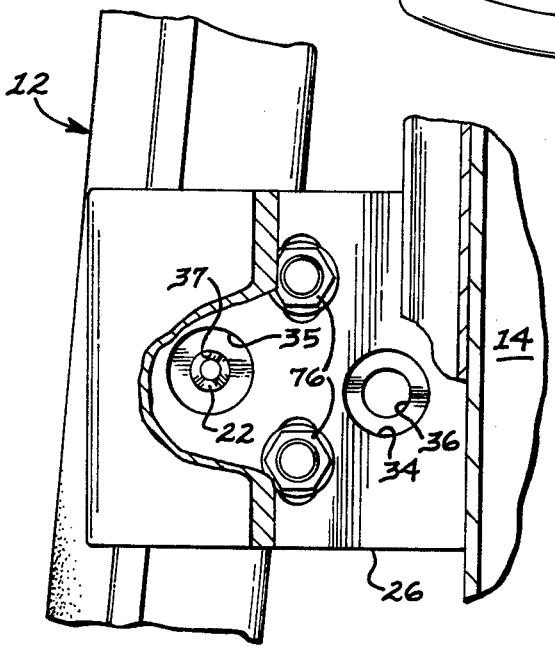
FIG. 5 is a schematic of the present invention shown from a top elevational view.

A bracket 26 has a mounting element 28 joined to the foundation member 14, an engagement plate 30, and a resilient member 32 disposed between the mounting element 28 and the engagement plate 30. The foundation member 14, engagement plate 30, and resilient member 32 are held together by fasteners 76. The engagement plate 30 and the resilient member 32 each have an opening 34,36 which is, respectively, at least as large as and smaller than the rod's diameter 22. The openings 34,36 are generally coaxially arranged for reception of one end of the rod 22 in the second position. The bracket 26 is shown having a pair of similar openings 35,37 spaced from openings 34,36 and disposed on an arc defined by pivotal movement of the door 13 (see FIG. 5). As the door 13 is opened, it must follow a curved path, and the apparatus 10, being attached to the door, must necessarily follow a similar path. Therefore, if the second pair of openings 35,37 were not disposed on the curved path followed by the apparatus 10, then alignment of the second pair of openings 35,37 with the rod 22 would not be possible.

INDUSTRIAL APPLICABILITY

Operation of the apparatus 10 is a very simple procedure requiring a minimum of time and attention by the operator of the vehicle. The door 13 is positioned under the bracket 26 with the rod 22 in general alignment with one pair of the openings 34,36. The operator supplies an upward force to the handle 23, sufficient to overcome the force exerted by the spring 50, and extends the rod 22 into the openings 34,36. The diameter of the opening 36 being smaller than the diameter of the rod 22 results in a friction fit as the rod 22 forces the opening 36 of the resilient member 32 to expand, thereby preventing vibration of the rod 22 against the bracket 36. As the rod 22 is forced upward, the recess 24 comes into general alignment with the second passage 20 and the torsion spring 45 causes the engagement portion 42 of the lever 40 to pivot into the recess 24. The operator then releases the handle 23 and the spring 50 urges the rod 22 back toward the first operating position at which the recess 24 is forced against the engagement portion 42 of the lever 40 locking the rod 22 at the second position and holding the door 13 at the selected position.

Releasing the apparatus 10 from the second operating position is an equally simple maneuver. The operator need only apply pressure to the handle 41 of the lever 40, pivot the engagement portion 42 from the recess 24 and free the rod 22 for movement by the spring 50 to the first operating position. The rod 22 is then spaced from the openings 34,36 and the door 13 is freed to swing. The spring 50 is sufficient in size and strength to maintain the rod 22 in the first operating position and reduce vibration of the rod.

Should the operator of the vehicle desire somewhat greater ventilation, he may pivot the door 13 further open and align the apparatus 10 with the second pair of openings 35,37 while forcing the rod 22 into the second locked position. Operation of the apparatus 10 is identical, independent of whether the operator selects the first openings 34,36 or the second openings 35,37.

Other aspects, objects and advantages of this invention can be obtained from a study of the drawings, the disclosure and the appended claims.

I claim:

1. An apparatus connectable to a pivotally movable partition for selectively locking the partition in an open position, said partition being pivotally connected to a foundation member, the apparatus comprising:

a body having first and second intersecting passages and being connectable to said partition;

a rod reciprocatably disposed in said first passage and movable between a first, unlocked position and a second, locked position, said rod having a diameter and a recess extending radially into said rod, said recess being alignable with said second passage at the second position of said rod;

a bracket having a mounting element joinable to the foundation member, an engagement plate, and a resilient member disposed between said mounting element and said engagement plate, said engagement plate and said resilient member each having a first opening at least as large as and smaller than said diameter of said rod, respectively, said openings being generally coaxially arranged for reception of one end of said rod at the second position of said rod, said mounting element and said engagement plate being fixed one relative to the other;

first biasing means for urging said rod in a direction toward said first position;

a lever pivotally connected to said body and having an engagement portion insertable into said recess through said second passage; and second biasing means for urging said engagement portion of said lever into said recess.

2. An apparatus, as set forth in claim 1, wherein said rod has a groove extending about the periphery of said rod and said first biasing means includes a ring disposed within the peripheral groove of said rod and extending beyond the diameter of said rod; and, a coil spring having first and second end portions and being radially disposed about said rod, said first and second end portions being in contact with said ring and said partition, respectively, said coil spring being axially compressible in response to movement of said rod in a direction from said first position toward said second position.

3. An apparatus, as set forth in claim 1, wherein said rod has a central axis and including means for preventing rotation of said rod about said central axis.

4. An apparatus, as set forth in claim 3, wherein said antirotation means includes said body having a third passage intersecting said first passage;

said rod having a keyway extending radially along said rod and in general alignment with said third passage; and, a key extending through said third passage and into said keyway of said rod.

5. An apparatus, as set forth in claim 1, wherein said engagement plate and said resilient member each have a second opening at least as large as and smaller than said diameter of said rod, respectively, said second openings being generally coaxially arranged and spaced from said first openings and positioned on an arc defined by pivotal movement of said partition.

6. A cab for a heavy equipment vehicle having a door pivotally connected to said cab and an apparatus for selectively locking said door in an open position, said apparatus comprising:

a body having first, second, and third passages and a flange portion, said first passage intersecting said second and third passages, and said body being connected to said door;

a rod having an annular groove and a keyway extending radially along said rod, said rod being reciprocatably disposed in said first passage and movable between a first unlocked position and a second locked position, said rod having a diameter and a recess extending radially into said rod, said recess being alignable with said second passage at the second position of said rod, said keyway being generally aligned with said third passage;

a bracket having a mounting element connected to the cab, an engagement plate, and a resilient member disposed between said mounting element and said engagement plate, said engagement plate and said resilient member each having an opening at least as large as and smaller than said diameter of said rod, said mounting element and said engagement plate being fixed one relative to the other, respectively, said openings being generally coaxially arranged for reception of one end of said rod at the second position of said rod;

a ring disposed within said annular groove of said rod and extending beyond the diameter of said rod;

a coil spring having first and second end portions and being disposed about said rods, said first and second end portions being in contact with said ring and said door, respectively, said coil spring being axially compressible in response to movement of said rod in a direction from said first position toward said second position;

a key connected to said body and extending through said third passage into said keyway;

a lever pivotally connected to said flange of said body by a pin, said lever having an engagement portion insertable into said recess through said second passage; and a torsion spring disposed about said pin and extending in a direction from said pin opposite said engagement portion and into contact with said lever.

* * * * *